US009417563B2

(12) United States Patent
Omata et al.

(10) Patent No.: US 9,417,563 B2
(45) Date of Patent: Aug. 16, 2016

(54) IMAGE FORMING APPARATUS

(71) Applicant: CANON KABUSHIKI KAISHA, Tokyo (JP)

(72) Inventors: Haruhiko Omata, Abiko (JP); Tatsuomi Murayama, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/857,996

(22) Filed: Sep. 18, 2015

(65) Prior Publication Data

US 2016/0091832 A1 Mar. 31, 2016

(30) Foreign Application Priority Data

Sep. 26, 2014 (JP) ..... 2014-196385

(51) Int. Cl.
*G03G 15/16* (2006.01)

(52) U.S. Cl.
CPC ..... *G03G 15/161* (2013.01)

(58) Field of Classification Search
CPC ..... G03G 15/161; G03G 15/1661; G03G 21/0035
See application file for complete search history.

(56) References Cited

U.S. PATENT DOCUMENTS 7,486,900 B2 2/2009 Omata
2007/0059028 A1* 3/2007 Nishikawa ..... G03G 21/0035 399/101
2007/0230994 A1* 10/2007 Takishita ..... G03G 15/161 399/101
2011/0103822 A1* 5/2011 Sugiura ..... G03G 15/161 399/101
2012/0087704 A1* 4/2012 Asaoka ..... G03G 15/0131 399/350
2013/0287421 A1* 10/2013 Makino ..... G03G 15/161 399/66
2014/0010567 A1* 1/2014 Tabata ..... G03G 15/168 399/101
2014/0023393 A1* 1/2014 Takai ..... G03G 21/0035 399/101
2014/0056609 A1* 2/2014 Sato ..... G03G 21/0076 399/101
2014/0064769 A1* 3/2014 Sugiura ..... G03G 21/0035 399/71
2015/0030349 A1* 1/2015 Osawa ..... G03G 15/161 399/101
2015/0147074 A1* 5/2015 Wada ..... G03G 15/161 399/21
2015/0261137 A1* 9/2015 Mitani ..... G03G 15/161 399/101
2015/0338784 A1* 11/2015 Ai ..... G03G 15/161 399/85

FOREIGN PATENT DOCUMENTS

JP 2006-259367 A 9/2006
JP 2007-057803 A 3/2007

* cited by examiner

*Primary Examiner* — Clayton E Laballe
*Assistant Examiner* — Ruifeng Pu
(74) *Attorney, Agent, or Firm* — Fitzpatrick, Cella, Harper & Scinto

(57) ABSTRACT

Relationships of LB1>LR1 and LN1<LN2 are satisfied, where LB1 is a length of a first contact area in which a first brush roller and an endless belt come into contact with each other. LR1 is a length of a second contact area in which the first roller and the endless belt come into contact with each other.
LN1 is a length of an area in which the first contact area and the second contact area overlap with each other. A third contact area is an area in which the second brush roller and the endless belt come into contact with each other. A fourth contact area is an area in which the second roller and the endless belt come into contact with each other. LN2 is a length of an area in which the third contact area and the fourth contact area overlap with each other.

19 Claims, 7 Drawing Sheets

IMAGE FORMING APPARATUS

BACKGROUND OF THE INVENTION

1. Field of the Invention

This disclosure relates to an image forming apparatus such as a copier, a printer, a facsimile, and a multifunction printer having a plurality of their functions.

2. Description of the Related Art

An intermediate transfer-type image forming apparatus which transfers a toner image formed on a photosensitive drum to an intermediate transfer belt and conveys the toner image to a transfer portion which transfers the toner image to a recording medium has been widely used. For example, JP-A-2007-57803 discloses an intermediate transfer-type image forming apparatus configured to clean an intermediate transfer belt by using an electrostatic cleaning-type belt cleaning unit.

By the way, the intermediate transfer belt is inclined to be attached with transfer residual toner charged with a polarity reverse to a toner charging polarity after transferring a toner image on a recording medium. Due to that, JP-A-2007-57803 collects the toner in an electrostatic manner from the intermediate transfer belt by abutting a second brush roller to which voltage of a polarity reverse to the toner charge polarity is applied with the intermediate transfer belt downstream of a first brush roller to which voltage of a same polarity with the toner charge polarity is applied.

A transfer belt-type image forming apparatus transferring a toner image borne on a photosensitive drum or the like to a recording medium carried on a transfer is also widely used. JP-A-2006-259367 discloses a transfer belt-type image forming apparatus configured to clean a transfer belt by using an electrostatic cleaning-type belt cleaning unit.

There is a case when the transfer belt is adhered with the toner charged with a polarity reverse to the charge polarity of the toner transferred from a patch toner image formed between images consecutively formed after separating the recording medium on which the toner image has been transferred. Due to that, JP-A-2006-259367 recovers the toner in an electrostatic manner from the secondary transfer belt by abutting a second brush roller to which voltage of a same polarity with the toner charge polarity is applied with the secondary transfer belt downstream of a first brush roller to which voltage of a polarity reverse to the toner charge polarity is applied.

It is desirable to be able to recover the toner more efficiently from the endless belt such as the intermediate transfer belt and the transfer belt with the configuration including the first and second brush rollers as described above.

SUMMARY OF THE INVENTION

According to one aspect of this disclosure, there is provided an image forming apparatus which includes a moving endless belt; a first brush roller configured to contact an outer circumferential surface of the endless belt; a first roller being in contact with an inner circumferential surface of the endless belt at a position corresponding to the first brush roller; a first power supply generating an electric field in a first direction between the first brush roller and the first roller; a second brush roller contacting the outer circumferential surface of the endless belt downstream of the first brush roller in a moving direction of the endless belt; a second roller being in contact with the inner circumferential surface of the endless belt at a position corresponding to the second brush roller; and a second power supply generating an electric field in a second direction which is a direction opposite to the first direction between the second brush roller and the second roller; in which relationships of LB1>LR1 and LN1<LN2 are satisfied, where LB1 is a length of a first contact area in the moving direction in which the first brush roller and the endless belt come into contact with each other, LR1 is a length of a second contact area in the moving direction in which the first roller and the endless belt come into contact with each other, a third contact area is an area in which the brush roller and the endless belt come into contact with each other, a fourth contact area is an area in which the second roller and the endless belt come into contact with each other, LN1 is a length of an area in which the first contact area overlaps with the second contact area in the moving direction, and LN2 is a length of an area in which the third contact area overlaps with the fourth contact area in the moving direction.

According to another aspect of this disclosure, there is provided an image forming apparatus which includes a moving endless belt; a first brush roller contacting an outer circumferential surface of the endless belt; a first roller being in contact with an inner circumferential surface of the endless belt at a position corresponding to the first brush roller; a first power supply generating an electric field in a first direction between the first brush roller and the first roller; a second brush roller contacting the outer circumferential surface of the endless belt downstream of the first brush roller in a moving direction of the endless belt; a second roller being in contact with the inner circumferential surface of the endless belt at a position corresponding to the second brush roller; and a second power supply generating an electric field in a second direction which is a direction opposite to the first direction between the second brush roller and the second roller, in which relationships of LN1/LB1<LN2/LB2 and LN1<LN2 are satisfied, where LB1 is a length of a first contact area in the moving direction in which the first brush roller and the endless belt come into contact with each other, a second contact area is an area in which the first roller and the endless belt come into contact with each other, LB2 is a length of a third contact area in the moving direction in which the second brush roller and the endless belt come into contact with each other, a fourth contact area is an area in which the second roller and the endless belt come into contact with each other, LN1 is a length of an area in which the first contact area overlaps with the second contact area overlap in the moving direction, and LN2 is a length of an area in which the third contact area overlaps with the fourth contact area in the moving direction.

Further features of the present invention will become apparent from the following description of exemplary embodiments with reference to the attached drawings.

DESCRIPTION OF THE EMBODIMENTS

First Embodiment

A first embodiment will be described using FIGS. 1 to 5.

(Image Forming Apparatus)

Figure 1:
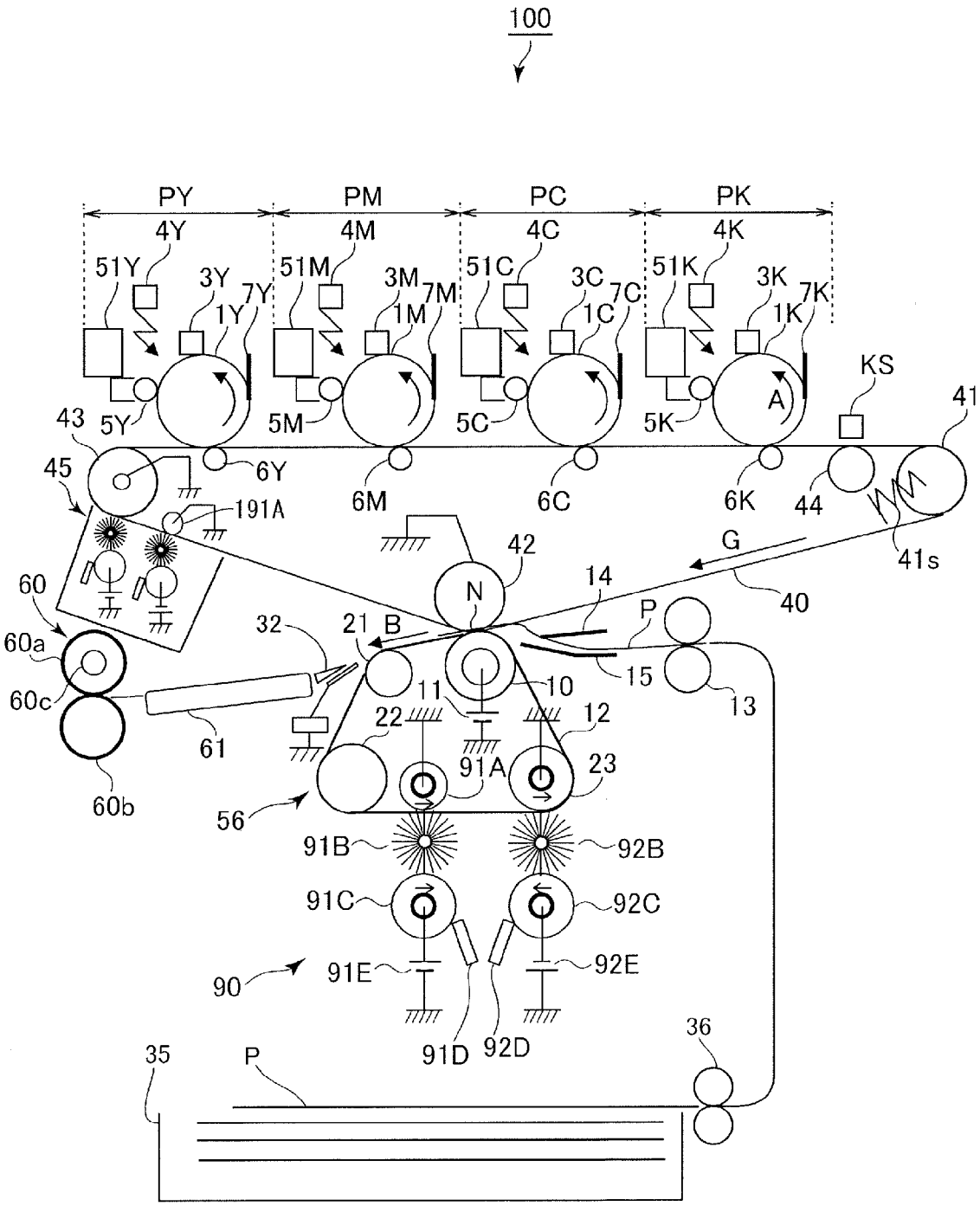
FIG. 1 is an explanatory diagram illustrating a configuration of an image forming apparatus according to a first embodiment.

FIG. 1 is a schematic diagram illustrating a configuration of an image forming apparatus. As illustrated in FIG. 1, the image forming apparatus 100 is a tandem intermediate transfer-type full color printer in which image forming portions PY, PM, PC, and PK are arranged along a rotating direction (moving direction) of an intermediate transfer belt 40.

In the image forming portion PY, a yellow toner image is formed on a photosensitive drum 1Y and is transferred to the intermediate transfer belt 40. In the image forming portion PM, a magenta toner image is formed on a photosensitive drum 1M and is transferred to the intermediate transfer belt 40. In the image forming portions PC and PK, a cyan toner image and a black toner image are formed on photosensitive drums 1C and 1K and are transferred to the intermediate transfer belt 40.

The toner images of the four colors which have been transferred to the intermediate transfer belt 40 are conveyed to a transfer portion N and are secondarily transferred to a recording medium P. The recording medium P is picked up from a recording media cassette 35, is separated one by one by a separating roller 36, and is sent to a registration roller 13. The registration roller 13 sends the recording medium P to the transfer portion N in synchronism with the toner image on the intermediate transfer belt 40.

The recording medium P on which the four-color toner image has been secondarily transferred is conveyed by a conveyor belt 61 and is sent to a fixing unit 60 to undergo heating and pressurizing process and to fix the image on the surface thereof. The fixing unit 60 applies a predetermined pressure and a quantity of heat at a nip formed by a fixing roller 60*a* provided with a heater 60*c* therein and a press roller 60*b* to melt and fix the toner image on the recording medium P.

(Image Forming Portion)

The image forming portions PY, PM, PC, and PK are constructed substantially in the same manner except of that the colors of toners used in developing units 5Y, 5M, 5C, and 5K are different from each other as yellow, magenta, cyan, and black. Accordingly, the image forming portion PY will be typically described, and an overlapped descriptions about the other image forming portions PM, PC, and PK will be omitted here.

In the image forming portion PY, a charging unit 3Y, an exposing unit 4Y, the developing unit 5Y, a primary transfer roller 6Y, and a drum cleaning unit 7Y are arranged surrounding the photosensitive drum 1Y. The photosensitive drum 1Y is provided with a photosensitive layer formed on an outer circumferential surface of an aluminum cylinder and rotates in a direction of an arrow A at a predetermined process speed.

The charging unit 3Y charges the photosensitive drum 1Y with a potential of a uniform negative polarity. The exposing unit 4Y scans a laser beam which is generated based on an image signal obtained by developing image data to a scanning line by using a rotating mirror and draws an electrostatic latent image based on the image data on the surface of the photosensitive drum 1Y.

The developing unit 5Y transfers toner negatively charged to the electrostatic latent image on the photosensitive drum 1Y and develops the electrostatic latent image as a toner image. A developer replenishing unit 51Y replenishes developer to the developing unit 5Y in accordance to the toner or the like consumed in the developing unit 5Y in forming the image.

The primary transfer roller 6Y as a first transfer member presses the intermediate transfer belt 40 and forms a primary transfer portion between the photosensitive drum 1Y and the intermediate transfer belt 40. When a voltage with a positive polarity is applied to the primary transfer roller 6Y, a toner image with a negative polarity which is borne on the photosensitive drum 1Y is transferred to the intermediate transfer belt 40.

The drum cleaning unit 7Y collects transfer residual toner adhering on the surface of the photosensitive drum 1Y by rubbing the photosensitive drum 1Y by a cleaning blade (Intermediate Transfer Belt)

The intermediate transfer belt 40, i.e., one exemplary image bearing member, rotates while bearing a toner image. The image forming portion PY forms a toner image, and causes the intermediate transfer belt 40 to bear the toner image.

The intermediate transfer belt 40 is stretched around a drive roller 43, a tension roller 41, and a secondary transfer inner roller 42, and rotates at a rotation speed of 250 mm/sec to 300 mm/sec in a direction of an arrow G by being driven by the drive roller 43. A circumferential length of the intermediate transfer belt 40 is 2000 mm, and diameters of the photosensitive drums 1Y, 1M, 1C, and 1K are 80 mm.

A thickness of the intermediate transfer belt 40 becomes 250 μm by arranging an elastic layer of a rubber material of 120 μm to 180 μm thick on a base layer of a resin material such as polyimide, polycarbonate, or the like, of 70 μm thick, and by arranging a surface layer of 5 μm to 10 μm thick on the elastic layer. The rubber material is urethane rubber, chloroprene rubber, or the like. The surface layer includes a fluororesin material which lessens adhesion of the toner to the surface of the intermediate transfer belt 40 and makes transferring of the toner to the recording medium P easier in the transfer portion N. Volume resistivity of the intermediate transfer belt 40, is adjusted to $1-10^9$ Ω·cm by containing an appropriate amount of carbon black i.e., an antistatic agent, in each layer.

The tension roller 41 applies a constant tensile force to the intermediate transfer belt 40 by pressure springs 41*s* disposed at both ends of a rotational axis and biased so as to protrude toward the intermediate transfer belt 40. A belt cleaning unit 45 collects transfer residual toner on the surface of the intermediate transfer belt 40 by contacting the intermediate transfer belt 40 by two fur brushes to which voltages of polarities reverse to each other are applied.

(Secondary Transfer Belt)

As illustrated in FIG. 1, a secondary transfer belt unit 56 causes the secondary transfer belt 12 to carry the recording medium P and to pass through the transfer portion N. It is possible to easily separate the recording medium P from the intermediate transfer belt 40 after transferring the toner image in the transfer portion N by using the secondary transfer belt 12.

The secondary transfer belt 12, i.e., an exemplary endless belt, moves while carrying the recording medium on an outer circumferential surface thereof. A secondary transfer outer roller 10, i.e., a transfer member or a second transfer member, transfers the toner image borne on the intermediate transfer belt 40 to the recording medium carried on the secondary transfer belt 12.

Figure 2:
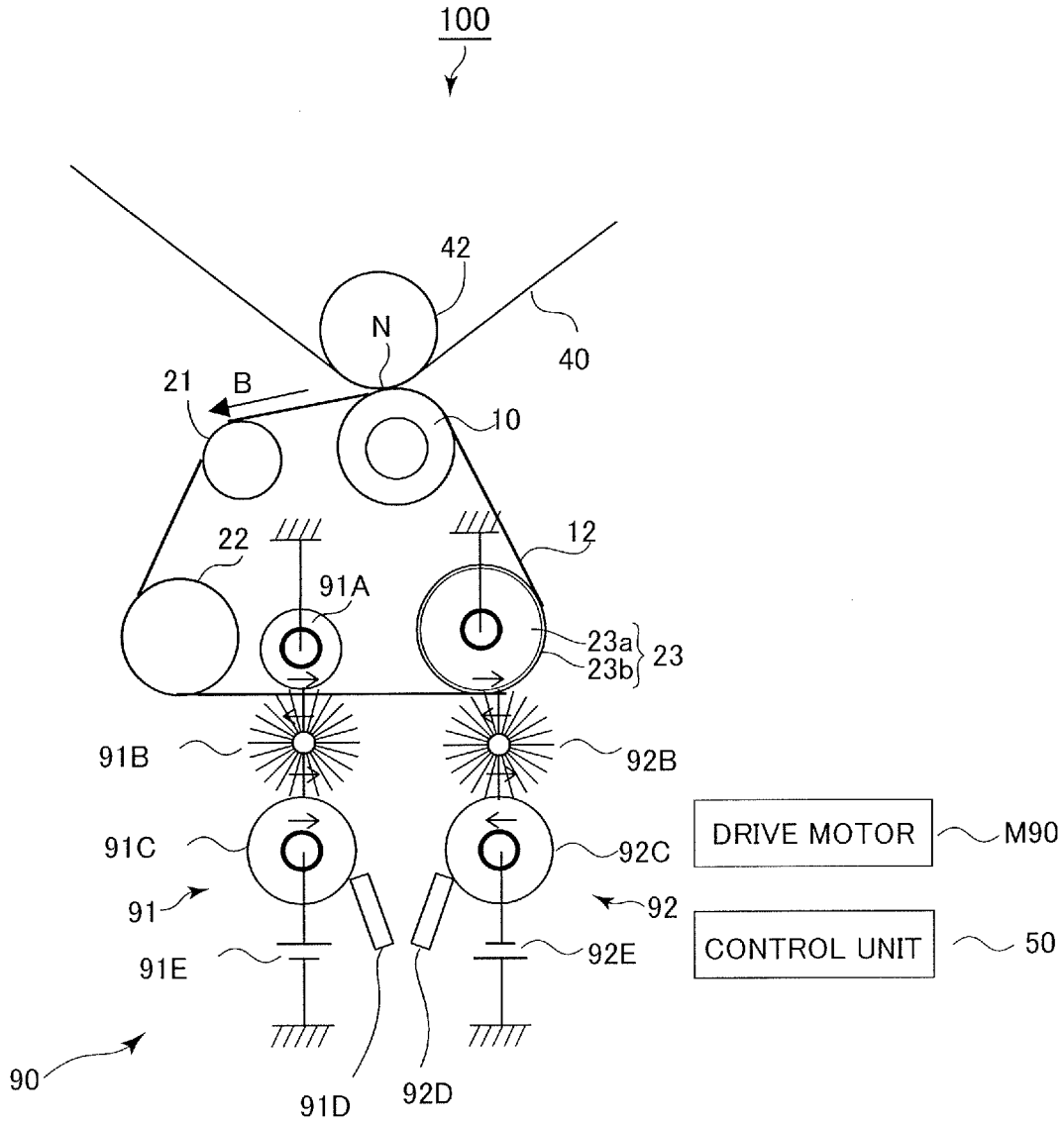
FIG. 2 is an explanatory diagram illustrating a configuration of a secondary transfer belt unit according to the first embodiment.

FIG. 2 is a schematic diagram illustrating a configuration of the secondary transfer belt unit. As illustrated in FIG. 2, in the secondary transfer belt unit 56, the secondary transfer belt 12 is stretched around the secondary transfer outer roller 10, a separating roller 21, a tension roller 22, and a drive roller 23. A circumferential length of the secondary transfer belt 12 is 200 mm.

The secondary transfer belt 12 is formed of a resin material in which volume resistivity is adjusted to $1\times10^{9}$ Ω·cm to $1\times10^{14}$ Ω·cm by containing an appropriate amount of carbon black, i.e., an antistatic agent, to a resin material such as polyimide, polycarbonate, or the like. The secondary transfer belt 12 is of a single layer structure and is 0.07 mm to 0.1 mm thick. A value of Young's modulus of the secondary transfer belt 12 measured by a tensile test (JIS K 6301) is 100 MPa or more and less than 10 GPa.

The secondary transfer outer roller 10 is formed so as to have an outer diameter of 24 mm by arranging an elastic layer 10*b* of ion conductive foaming rubber (NBR rubber) at the outer periphery of a cored metal 10*a*, i.e., a stainless steel round bar. The ten point average surface roughness Rz of the elastic layer 10*b* is 6.0 μm to 12.0 μm, and Asker-C hardness is approximately 30 to 40. A resistance value of the secondary transfer outer roller 10 measured by applying 2 kV in a normal temperature and humidity (N/N:23° C., 50% RH) is $1\times10^{5}$ Ω·cm to $1\times10^{7}$ Ω·cm.

In the transfer portion N, the secondary transfer inner roller 42 supports the inner circumferential surface of the intermediate transfer belt 40.

The secondary transfer outer roller 10 forms the toner image transfer portion N between the intermediate transfer belt 40 and the secondary transfer belt 12 by nipping the intermediate transfer belt 40 and the secondary transfer belt 12 between the secondary transfer inner roller 42 and the secondary transfer outer roller 10. A secondary transfer power supply 11 whose output current is variable is connected to the secondary transfer outer roller 10.

Constant current control is made on output voltage of the secondary transfer power supply 11 such that a transfer current of +40 μA to 60 μA flows. The secondary transfer power supply 11 applies a transfer voltage to the secondary transfer outer roller 10 and secondarily transfers the toner image borne on the intermediate transfer belt 40 to the recording medium P on the secondary transfer belt 12. The recording medium P is adsorbed to the secondary transfer belt in an electrostatic manner along with the secondary transfer of the toner image.

The separating roller 21 separates a recording medium from the secondary transfer belt 12 on the downstream of the transfer portion N. The recording medium P on the secondary transfer belt 12 reaches the separating roller 21, and is then curvature-separated from the secondary transfer belt 12 on a curved face of the secondary transfer belt 12 along the circumferential surface of the separating roller 21. A separation claw 32 prevents the recording medium P separated from the secondary transfer belt 12 from electrostatically winding around the secondary transfer belt 12 again.

The drive roller 23 is connected with a drive motor (not illustrated) and drives the secondary transfer belt 12 to rotate in a direction of an arrow B direction. Both ends of the tension roller 22 are biased by pressure springs in a direction in which the tension roller 22 projects toward the secondary transfer belt 12 to apply predetermined tension to the secondary transfer belt 12.

The recording medium P which is curvature-separated from the secondary transfer belt 12 is sent to the fixing unit 60 by being conveyed to the conveyor belt 61. The recording medium on which the image has been fixed by the fixing unit 60 is discharged out of the image forming apparatus 100.

(Patch Cleaning)

The image forming apparatus 100 forms a patch toner image of each color between toner images (between images) formed consecutively on the respective recording media and measures density (reflected light amount of infrared light) of the patch toner image transferred onto the intermediate transfer belt 40 using an optical sensor KS (FIG. 1). Controls in which density of the patch toner image is fed back include setting of laser power, setting of developing voltage, an adjustment of a toner replenishment amount, and the like. While an output voltage of the secondary transfer power supply 11 is turned OFF when a part between images, on which the patch toner image is to be formed, passes through the transfer portion N, there is a case in which a part of toner of the patch toner image is transferred to the secondary transfer belt 12 from the intermediate transfer belt 40, because the intermediate transfer belt 40 and the secondary transfer belt 12 being in close contact with each other are pressed.

There is also a case in which a toner image which has not been transferred to the recording medium remains on the intermediate transfer belt 40 when a recording medium is jammed in a middle of an image forming operation and a process of taking out the jammed recording medium is performed. In this case, there is a possibility that part of toner of the toner image moves to the secondary transfer belt 12 when the remaining toner image passes through the transfer portion N.

Due to that, the image forming apparatus 100 is provided with an electrostatic cleaning-type belt cleaning unit 90 on the secondary transfer belt 12 to collect the toner adhering on the secondary transfer belt 12. Because the electrostatic cleaning-type belt cleaning unit 90 uses no cleaning blade, no trouble involved in the cleaning blade occurs.

(Belt Cleaning Unit)

As illustrated in FIG. 2, the belt cleaning unit 90 collects the toner positively charged by using a fur brush 92B to which a negative voltage is applied after collecting the negatively charged toner by using a fur brush 91B to which a positive voltage is applied.

The fur brushes 91B and 92B and metallic rollers 91C and 92C are connected to a drive motor M90 via a gear mechanism, and rotate in directions of arrows, respectively, by being driven by the drive motor M90.

The fur brushes 91B and 92B rotate in a direction opposite from a moving direction of the secondary transfer belt 12 at a position facing the secondary transfer belt 12 and contact the secondary transfer belt 12. The fur brush 92B rotates in a direction also opposite to a rotation direction of the metallic roller 92C and contacts the metallic roller 92C. The fur brush 91B rotates in a same direction with a rotation direction of the metallic roller 91C and contacts the metallic roller 91C.

The fur brushes 91B and 92B are implanted with hairs of conductive nylon fiber of which volume resistivity is $10^{5}$ Ω·cm and a diameter thereof is 18 mm. An inroad amount of the secondary transfer belt 12 into the fur brushes 91B and 92B is 1.5 mm. A diameter of the metallic rollers 91C and 92C is 20 mm, respectively. An inroad amount of the metallic rollers 91C and 92C into the fur brushes 91B and 92B is 2 mm. A support roller 91A is an aluminum columnar roller whose diameter is 13 mm. In the drive roller 23, a rubber material of which a thickness is 0.5 mm and volume resistivity is $10^5$ Ω·cm is covered on a circumferential surface of a stainless steel columnar roller. A diameter thereof is 22 mm.

The support roller 91A is a metallic roller connected to a ground potential, rotates by being driven by the secondary transfer belt 12, and supports the secondary transfer belt 12 which is contacted by the fur brush 91B. A power supply 91E applies a voltage with a positive polarity to the metallic roller 91C. The fur brush 91B which comes into contact with the metallic roller 91C is charged with a positive polarity and adsorbs toner negatively charged and adhering on the secondary transfer belt 12. The toner which is collected by the fur brush 91B is moved to the metallic roller 91C whose positive potential is higher and is then scraped off by a cleaning blade 91D.

Still further, the toner of which the charged polarity is changed from a negative polarity to a positive polarity while rotating by adhering to the fur brush 91B returns to the secondary transfer belt 12 from the fur brush 91B, and is collected by the fur brush 92B thereafter, in a process of passing through the fur brush 92B.

The drive roller 23 is a metallic roller 23*a* covered with conductive rubber 23*b*, rotationally drives the secondary transfer belt 12, and supports the secondary transfer belt 12 which is contacted with the fur brush 92B. A power supply 92E applies a voltage with a negative polarity to the metallic roller 92C. The fur brush 92B which comes into contact with the metallic roller 92C is charged with a negative polarity, and adsorbs toner positively charged and adhering on the secondary transfer belt 12. The toner collected by the fur brush 92B is moved to the metallic roller 92C whose negative potential is higher and is then scraped off by a cleaning blade 92D.

As described above, a cleaning portion 91 includes the fur brush 91B as one example of the first brush roller, the support roller 91A as one example of the first roller, and the power supply 91E as one example of the first power supply. The fur brush 91B contacts the outer circumferential surface of the secondary transfer belt 12 from which a recording medium on which the toner image had been transferred has been separated. The support roller 91A comes into contact with the inner circumferential surface of the secondary transfer belt 12 at a position corresponding to the fur brush 91B. In other words, the support roller 91A is arranged so as to nip the secondary transfer belt 12 with the fur brush 91B. The power supply 91E generates an electric field between the fur brush 91B and the support roller 91A in a first direction. Still further, the metallic roller 91C as the first collecting roller collects toner from the fur brush 91B while being in contact with the fur brush 91B. The cleaning blade 91D as the first cleaning member removes the toner from the metallic roller 91C while being contact with the metallic roller 91C.

A cleaning portion 92 includes the fur brush 92B as an example of the second brush roller, the drive roller 23 as an example of the second roller, and the power supply 92E as an example of a second power supply. The fur brush 92B contacts the outer circumferential surface of the secondary transfer belt 12 downstream of the fur brush 91B in the moving direction of the secondary transfer belt 12. In other words, the fur brush 92B contacts the outer circumferential surface of the secondary transfer belt 12 which has been contacted by the fur brush 91B. The drive roller 23 comes into contact with the inner circumferential surface of the secondary transfer belt 12 at a position corresponding to the fur brush 92B. In other words, the drive roller 23 is arranged so as to nip the secondary transfer belt 12 with the fur brush 92B. The power supply 92E generates an electric field between the fur brush 92B and the drive roller 23 in a second direction which is opposite to the first direction, i.e., in a direction opposite to the electric field generated by the power supply 91E. Still further, the metallic roller 92C, i.e., the second collecting roller, collects the toner from the fur brush 92B while being in contact with the fur brush 92B. The cleaning blade 92D, i.e., a second cleaning member, removes the toner from the metallic roller 92C while being in contact with the metallic roller 92C.

Here, in the belt cleaning unit in which voltages whose polarities are reverse to each other are applied to the fur brush 91B and the fur brush 92B, it is unable to collect the toner charged with polarity to be collected by the upstream fur brush 91B by the downstream fur brush 92B. Due to that, it has been considered to collect the toner charged with the polarity to be collected by the fur brush 91B is collected by the fur brush 91B by increasing voltage to be applied to the upstream fur brush 91B. However, it turned out that, when the voltage to be applied to the fur brush 91B is increased, an amount of toner which cannot be collected by the downstream fur brush 92B increases, because a charge amount increases due to charge injection caused by discharge in the fur brush 91B.

For example, in the image forming apparatus 100, if an amount of toner of a patch toner image increases, an amount of toner which can be cleaned also increases by increasing the voltage to be applied to the fur brush 91B. However, in parallel with that, toner which returns to the secondary transfer belt 12 from the upstream fur brush 91B also increases.

Then, the toner which passes through without being cleaned by the fur brush 91B is mixed with toner charged with both polarities and cannot be completely cleaned by the downstream fur brush 92B. Therefore, if the voltage to be applied to the fur brush 92B is increased, the charged polarity of the toner is reversed also in the fur brush 92B, causing passing-through.

Accordingly, it is desirable to provide an image forming apparatus in which, even when a voltage to be applied to the upstream fur brush 91B is increased, it is possible to exhibit high cleaning performance with respect to the endless belt such as the secondary transfer belt 12 by efficiently collecting toner using the fur brush 91B and the fur brush 92B.

Therefore, it was verified whether or not there is a room for improving cleaning performance of the belt cleaning unit 90 by changing diameters of the drive roller 23 and the support roller 91A to multiple stages. It was verified whether or not it is possible to secure sufficient cleaning latitude by which a cleaning failure can be prevented, even in the case when an amount of toner to be cleaned such as a patch toner image for adjusting density is increased in the configuration of an electrostatic fur brush cleaning.

(Comparison Experiment)

A comparison experiment by which the cleaning performance is studied by changing diameters of the support roller and the drive roller will be described. As illustrated in FIG. 1, because the secondary transfer belt unit 56 is downsized, it is preferable to downsize the belt cleaning unit 90, as well. Still further, because a process speed of the image forming apparatus 100 is 250 mm/sec to 300 mm/sec, it is desirable for the belt cleaning unit 90 to exhibit sufficient toner cleaning performance with respect to the secondary transfer belt 12 which rotates at this peripheral velocity.

Figure 3:
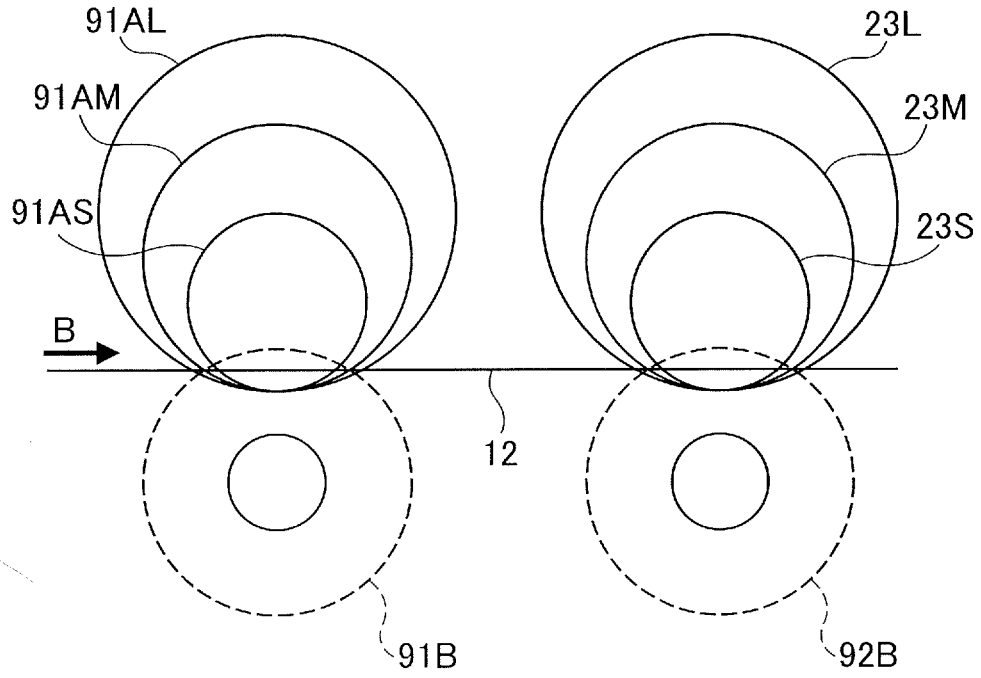
FIG. 3 is an explanatory diagram illustrating an experiment in which diameters of a support roller and of a drive roller are changed.

Therefore, as illustrated in FIG. 3, nine combinations were made by changing diameters of the drive roller 23 and the support roller 91A to three types (23L, 23M, 23S, 91AL, 91AM, and 91AS) of 13 mm, 16 mm, and 22 mm, respectively. For each of the combinations, cleaning performance of the belt cleaning unit 90 was evaluated and compared by rotating the secondary transfer belt 12 at the same peripheral velocity of 300 mm/sec.

TABLE 1

| Diameter of support roller | Diameter of drive roller | Cleaning performance |
|---|---|---|
| large | large | X |
| medium | large | X |
| small | large | ○ |
| large | medium | X |
| medium | medium | X |
| small | medium | Δ |
| large | small | X |
| medium | small | X |
| small | small | Δ |

As illustrated in Table 1, the toner cleaning performance of the belt cleaning unit 90 was improved when the diameter of 13 mm (91AS) was selected for the support roller 91A, and when the diameter of 22 mm (23L) was selected for the drive roller 23. Toner cleaning performance of the belt cleaning unit 90 was degraded when the diameter of 22 mm (91AL) was selected for the support roller 91A, and the diameter of 13 mm (23S) was selected for the drive roller 23.

Next, a computer simulation was performed under the conditions indicated in Table 1, and a contact length of the support roller 91A being in contact with the secondary transfer belt 12 LR1, and a contact length of the fur brush 91B being in contact with the secondary transfer belt 12 LB1 were obtained. Still further, a nip length of the secondary transfer belt 12 in contact with the support roller 91A and the fur brush 91B LN1, and a nip length of the secondary transfer belt 12 in contact with the drive roller 23 and the fur brush 92B LN2 were similarly obtained.

TABLE 2

| Contact length on upstream side | Comparison of nip length | Cleaning performance |
|---|---|---|
| brush contact length < roller contact length | length on upstream side = length on downstream side | X |
| brush contact length = roller contact length | length on upstream side < length on downstream side | X |
| brush contact length > roller contact length | length on upstream side < length on downstream side | ○ |
| brush contact length < roller contact length | length on upstream side > length on downstream side | X |
| brush contact length = roller contact length | length on upstream side = length on downstream side | X |
| brush contact length > roller contact length | length on upstream side < length on downstream side | Δ |
| brush contact length < roller contact length | length on upstream side > length on downstream side | X |
| brush contact length = roller contact length | length on upstream side > length on downstream side | X |
| brush contact length > roller contact length | length on upstream side = length on downstream side | Δ |

As illustrated in Table 2, the cleaning performance was remarkably enhanced when a contact length of the fur brush 91B in contact with the secondary transfer belt 12 (brush contact length LB1) is longer than that of the support roller 91A in contact with the secondary transfer belt 12 (roller contact length LR1), and when a nip length of the secondary transfer belt 12 of the fur brush 92B (length on a downstream side LN2) is longer than that of the fur brush 91B (length on an upstream side LN1).

(Examination on Experiment Result)

As illustrated in FIG. 2, toner on the secondary transfer belt 12 which is charged with a negative polarity is moved to the fur brush 91B to which a potential with a positive polarity is applied, in an electrostatic manner via the metallic roller 91C. Still further, the toner which is charged with a negative polarity is moved to the metallic roller 91C from the fur brush 91B, and is cleaned using the cleaning blade 91D thereafter. At this time, toner on the secondary transfer belt 12 which is charged with a positive polarity passes through the fur brush 91B; however, the toner is collected by the fur brush 92B which is disposed downstream of the fur brush 91B, and to which a potential with a negative polarity is applied.

Still further, toner of which a charge with a negative polarity is lost by being in contact with the fur brush 91B, or toner which is originally not charged is hardly moved to the metallic roller 91C from the fur brush 91B even when being transferred to the fur brush 91B. Due to that, there is a case in which the toner of which a charge is lost, or the toner which is originally not charged returns to the secondary transfer belt 12 from the fur brush 91B when being in contact with the secondary transfer belt 12 by passing through the metallic roller 91C while adhering to the fur brush 91B.

In many cases, in the toner which returned to the secondary transfer belt 12 when being in contact with the secondary transfer belt 12, by passing through the metallic roller 91C while adhering to the fur brush 91B, a charged amount of the toner is changed due to discharging at the periphery of the fur brush 91B. There also is a case in which a charged polarity of the toner is reversed.

Therefore, an experiment in which toner of which a charge is lost, or toner which is originally not charged is collected in the metallic roller 91C was performed, by increasing a voltage with a positive polarity which will be applied to the metallic roller 91C. However, when the voltage with a positive polarity which will be applied to the metallic roller 91C is increased, toner particles which are charged with a high positive polarity are generated on the secondary transfer belt 12 due to discharging, and it was not possible to sufficiently collect toner in the fur brush 91B to which a voltage with a negative polarity is applied.

Still further, in order to increase productivity of the image forming apparatus 100, it is required to increase a rotation speed of the secondary transfer belt 12 by increasing a so-called process speed. In the belt cleaning unit 90, when the rotation speed of the secondary transfer belt 12 is increased, it is required to also increase an applied voltage by increasing a rotation speed of the fur brush 91B, since a time for the fur brush 91B to contact the secondary transfer belt 12 becomes short. However, both of increasing the rotation speed of the fur brush 91B and increasing the applied voltage easily cause discharging in the fur brush 91B, which leads to an increase in toner particles of which a charged amount is large on the secondary transfer belt 12.

Still further, when toner which is charged with a positive polarity and toner which is charged with a negative polarity reach the downstream fur brush 91B together, the fur brush 92B to which a voltage with a negative polarity is applied is incapable of completely collecting toner which is charged with a negative polarity. However, when it is set so as to collect toner which is charged with a negative polarity, by applying a voltage with a high positive polarity to the upstream fur brush 91B, toner which returns to the secondary transfer belt 12 by being injected with a charge from the fur brush 91B is charged with a high positive polarity. Due to that, the downstream fur brush 91B is incapable of sufficiently collecting toner on the secondary transfer belt 12. In an area in which the secondary transfer belt 12 passes through the fur brush 91B with a rotation of the secondary transfer belt 12, discharging is generated between the fur brush 91B and toner particles on the secondary transfer belt 12, and the toner particles on the secondary transfer belt 12 are charged with a positive polarity. Still further, the toner particles on the secondary transfer belt 12 which are charged with a high positive polarity due to discharging passes through the downstream fur brush 92B which is applied with a potential with a negative polarity.

Figure 4:
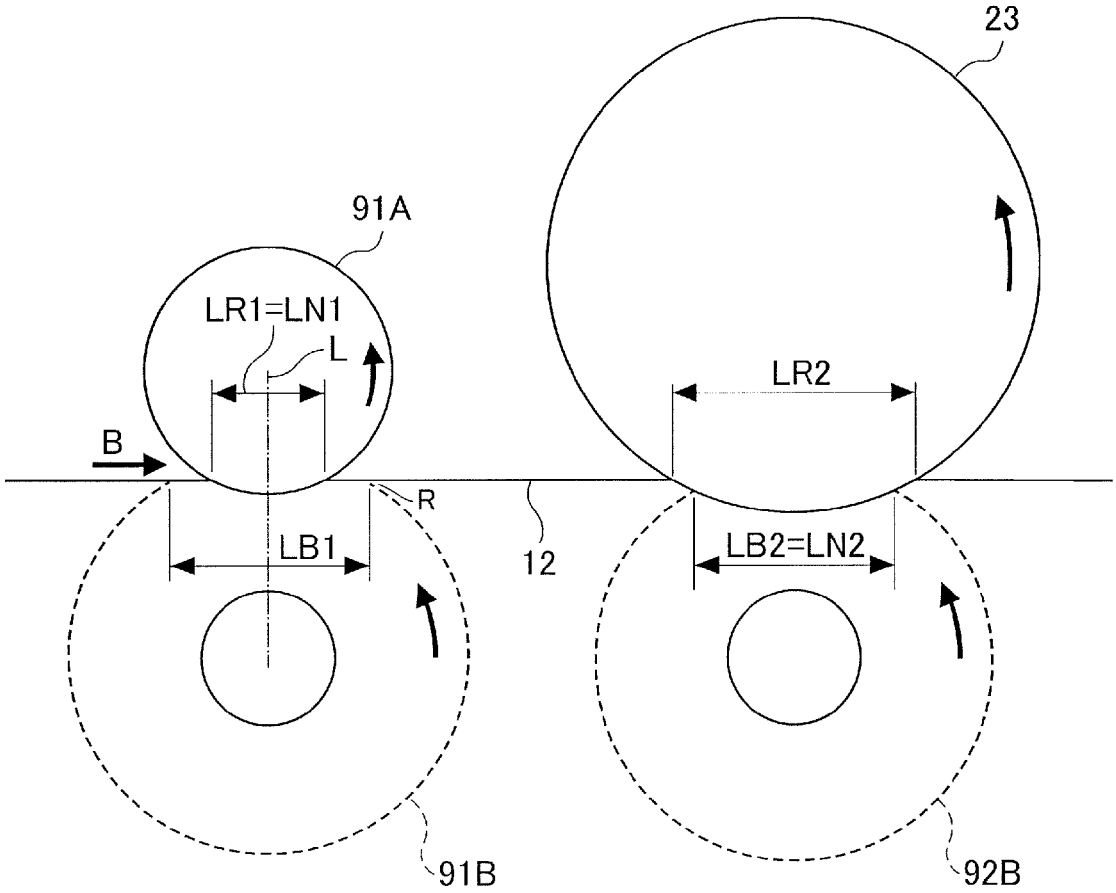
FIG. 4 is an explanatory diagram illustrating a contact length between a fur brush and the support roller according to the first embodiment.

However, as illustrated in FIG. 4, when a diameter of the support roller 91A is set to be small, for example, 13 mm, toner particles which are charged with a positive polarity are rarely generated on the secondary transfer belt 12, even when a voltage with a positive polarity which will be applied to the metallic roller 91C is increased. The reason for this is that, when a diameter of the support roller 91A is set to be small, because the fur brush 91B of which a diameter is relatively large starts to be separated from the secondary transfer belt 12 in an area which is a small electric field and is far from the support roller 91A, discharging is hardly generated. It is considered that, in this manner, since the fur brush 91B starts to be separated from the secondary transfer belt 12 at a position in which an electric field is weak by setting the diameter of the support roller 91A small, toner is hardly injected with a charge, and toner which returns to the secondary transfer belt 12 is not charged with a high positive polarity.

Meanwhile, in the downstream fur brush 91B, in an area in which the secondary transfer belt 12 is separated from the fur brush 92B with a rotation of the secondary transfer belt 12, there is almost no residual toner on the secondary transfer belt 12. Due to that, there is no problem even when discharging is generated between the fur brush 92B and the secondary transfer belt 12. More than that, it is efficient to collect toner from the secondary transfer belt 12 by causing the fur brush 92B to come into contact with an area of the secondary transfer belt 12 of which the inner circumferential surface is supported by the drive roller 23, and in which a high electric field is generated as long as possible.

Due to that, as described above, it is considered that toner cleaning performance of the belt cleaning unit 90 is enhanced when setting a diameter of the drive roller 23 to 22 mm, compared to a case in which the diameter is set to 13 mm and 16 mm. It is considered that, in the downstream fur brush 91B, it is possible to collect toner which is charged with a high positive polarity to some extent, by causing the fur brush 92B contact the secondary transfer belt 12 as long as possible on the drive roller 23.

(Examination on Discharging)

As illustrated in FIG. 4, a length of the first contact area in which the fur brush 91B as an example of the first brush roller and the secondary transfer belt 12 which is an example of an endless belt come into contact with each other is set to LB1. A length of the second contact area in which the support roller 91A as an example of the first roller and the secondary transfer belt 12 come into contact with each other is set to LR1. A length of a third contact area in which the fur brush 92B as an example of the second brush roller and the secondary transfer belt 12 come into contact with each other is set to LB2. A length of a fourth contact area in which the drive roller 23 as an example of the second roller and the secondary transfer belt 12 come into contact with each other is set to LR2. A length of an area in which the first contact area and the second contact area overlap with each other in the moving direction of the secondary transfer belt 12 is set to LN1, and a length of an area in which the third contact area and the fourth contact area overlap with each other in the moving direction of the secondary transfer belt 12 is set to LN2.

As illustrated in FIG. 4, there is a possibility that discharging is generated in a vacant space R in which the secondary transfer belt 12 passes through the fur brush 91B with a movement of the secondary transfer belt 12. When a voltage is applied between the support roller 91A and the fur brush 91B, an electric field is strongest on a line L which is formed by connecting a center of the support roller 91A and a center of the fur brush 91B, and becomes gradually weak with the distance from the line L toward the upstream side and the downstream side. Due to that, discharging which is generated in the vacant space R becomes strong as being close to the line L, and becomes weak with the distance from the line L.

In this manner, since an electric field which causes discharging becomes strong when a distance between the vacant space R and the support roller 91A is shorter, discharging which is generated in the vacant space R becomes strong when the distance between the vacant space R and the support roller 91A is shorter. When such discharging is generated around toner, a charged polarity and a charged amount of toner are changed since a discharged charge jumps into toner. Accordingly, since it is possible to make the distance between the vacant space R and the support roller 91A long by setting LB1>LR1, discharging which is generated in the vacant space R is remarkably suppressed, and an amount of toner which returns to the secondary transfer belt 12 from the fur brush 91B is reduced.

Meanwhile, when toner passes through at the downstream fur brush 91B, back surface staining occurs in a recording medium such as a sheet. Toner reaching the fur brush 92B includes not only toner which is charged with a reverse polarity (positive) but also uncharged toner with a charged amount of approximately zero which cannot be collected by the upstream fur brush 91B. The uncharged toner adheres to the secondary transfer belt 12 due to a physical adhesive force, not an electrostatic adhesive force. In order to collect the uncharged toner, it is effective to make a contact area between the secondary transfer belt 12 which is supported by the drive roller 23 and the fur brush 92B long by making the drive roller 23 large, compared to a case in which discharging in the vicinity of toner is reduced by the drive roller 23 being set to be small. That is, when LN1<LN2, it is possible to collect much more toner from the secondary transfer belt 12 in the downstream fur brush 91B.

Still further, LN1/LB1 and LN2/LB2 are ratios of an effective cleaning area (range in which cleaning electric field is strong) to a contact length of a fur brush. The larger the value, the fur brush can adsorb toner for a long time in a process of being in contact with the secondary transfer belt 12. Due to that, when the relationships of LN1/LB1<LN2/LB2, and LN1<LN2 are satisfied, role sharing in which discharging is suppressed in the upstream fur brush 91B, while enhancing toner collecting performance in the downstream fur brush 91B becomes more clear.

Figure 5:
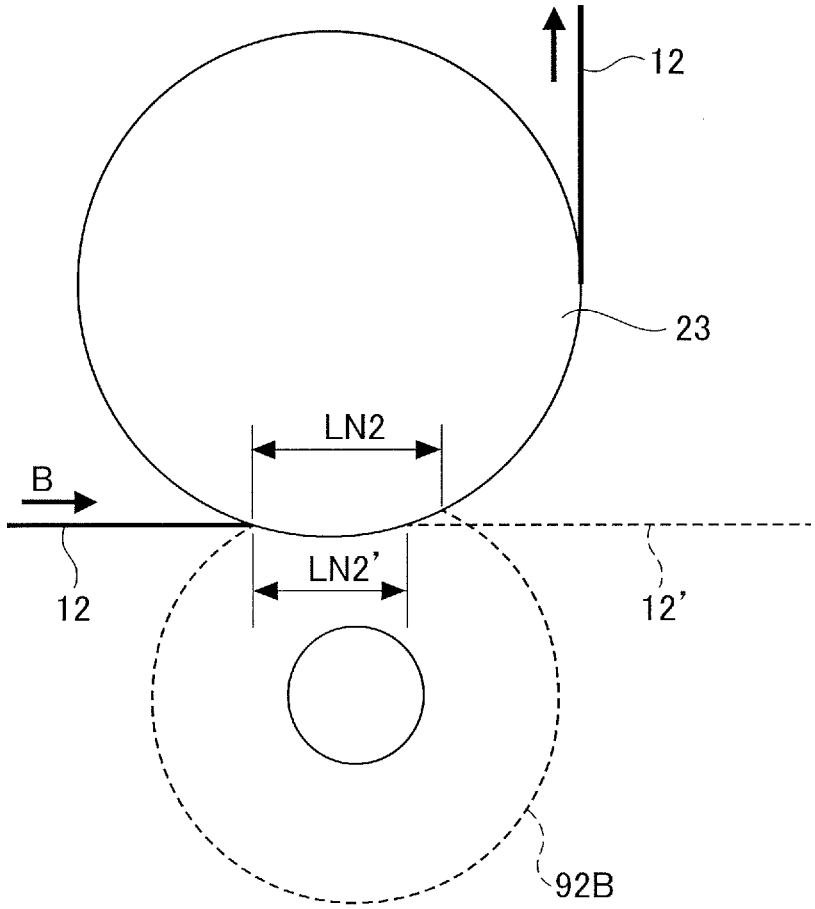
FIG. 5 is an explanatory diagram illustrating a face of a secondary transfer belt around of which the drive roller is wound according to the first embodiment.

As illustrated in FIG. 5, according to the first embodiment, the length LN2 in a range in which a cleaning electric field is strong is secured by causing the fur brush 92B to come into contact with a curved face on which the secondary transfer belt 12 is wound around the drive roller 23.

That is, the drive roller 23 which faces the fur brush 92B by interposing the secondary transfer belt 12 therebetween is a roller which is wrapped by and stretches the secondary transfer belt 12. Due to that, it is possible to make LN2 long. In contrast to this, when a secondary transfer belt 12' is not stretched by the drive roller 23, and a face of the secondary transfer belt 12' which comes into contact with the fur brush 92B is planar, a length of a range in which a cleaning electric field is strong becomes LN2' which is shorter than LN2. Accordingly, it is possible to enhance cleaning performance of the belt cleaning unit 90 by causing the fur brush 92B to come into contact with the curved face of the secondary transfer belt 12 which is wound around the drive roller 23.

It is noted that discharging is also generated at a portion in which the secondary transfer belt 12 rushes into the fur brush 92B with a movement of the secondary transfer belt 12. However, a phenomenon in which toner returns to the secondary transfer belt 12 from the fur brush 92B, easily occurs at a portion in which the secondary transfer belt 12 passes through the fur brush 92B, not a portion in which the secondary transfer belt 12 rushes into the fur brush 92B, and has a large influence on cleaning performance.

As described above, a length of the first contact area in which the fur brush 91B comes into contact with the secondary transfer belt 12 is set to LB1. A length of the second contact area in which the support roller 92A comes into contact with the secondary transfer belt 12 is set to LR1.
A length of an area in which LB1 and LR1 overlap with each other in the moving direction is set to LN1.

Still further, a length of a third contact area in which the fur brush 92B comes into contact with the secondary transfer belt 12 is set to LB2. A length of a fourth contact area in which the drive roller 23 comes into contact with the secondary transfer belt 12 is set to LR2. A length of an area in which LB2 and LR2 overlap with each other in the moving direction is set to LN2.

According to the first embodiment, at this time, the relationships of LB1>LR1 and LN1<LN2 hold. At the same time, the relationships of LN1/LB1<LN2/LB2 and LN1<LN2 hold.

According to the first embodiment, due to a relationship of LB1>LR1, injection of a charge into toner on the secondary transfer belt 12 due to discharging is reduced even when a voltage which is applied to the fur brush 91B is increased. Still further, due to a relationship of LN1<LN2, collecting efficiency with respect to toner with a large charged amount is improved. Accordingly, it is possible to exhibit high cleaning performance with respect to the secondary transfer belt 12 by efficiently collecting toner using the fur brush 91B and the fur brush 92B, even when a voltage which is applied to the fur brush 91B is increased.

According to the first embodiment, since a relationship in each of the above described expressions is satisfied, a charged state of toner which passes through the fur brush 91B, or toner which returns to the secondary transfer belt 12 enter a state in which the toner is easily collected by the fur brush 92B, a cleaning failure hardly occurs.

According to the first embodiment, when setting a diameter of the support roller 91A to DR1, and a diameter of the drive roller 23 to DR2, a relationship of DR1<DR2 holds. Due to that, relationships of LB1>LR1 and LN1<LN2, or relationships of LN1/LB1<LN2/LB2 and LN1<LN2, and relationships of LB1>LR1 and LN1<LN2 can be easily satisfied. It is easy to design the belt cleaning unit 90 by assorting diameters of the fur brush 91B and the fur brush 92B, and an inroad amount of the secondary transfer belt 12 into the fur brushes 91B and 92B.

According to the first embodiment, the drive roller is a roller wrapped around and stretching the secondary transfer belt 12 after separating a recording medium therefrom. Due to that, it is not required to provide an exclusive support roller, and it is possible to downsize the secondary transfer belt unit 56.

According to the first embodiment, the drive roller 23 is configured by covering the circumferential surface of a metallic roller 23*a* with conductive rubber 23*b*. Due to that, a resistance between the metallic roller 23*a* and the fur brush 92B increases compared to a case in which the metallic roller 23*a* is in direct contact with the secondary transfer belt 12, and discharging between the secondary transfer belt 12 and the fur brush 92B is hardly generated.

According to the first embodiment, a voltage of V1 of which a polarity is reverse to a charged polarity of toner is applied to the fur brush 91B, and a voltage of V2 of which a polarity is the same as the charged polarity of toner is applied to the fur brush 92B. At this time, a relationship of |V1|>|V2| holds. Therefore, it is possible to collect transfer residual toner efficiently and in large quantities by the upstream fur brush 91B while satisfying the relationship of LN1<LN2, or the relationships of LN1/LB1<LN2/LB2 and LN1<LN2, and the relationships of LB1>LR1 and LN1<LN2.

Still further, in order to increase productivity of the image forming apparatus, it is required to increase a rotation speed of the secondary transfer belt 12 by increasing a so-called process speed. When the rotation speed of the secondary transfer belt 12 is increased, in the belt cleaning unit 90, it is required to increase an applied voltage, as well, by increasing a rotation speed of the fur brush 91B, since a time for the fur brush 91B to contact a belt becomes short.

According to the first embodiment, it is possible to secure toner cleaning performance by making discharging is hardly generated in the fur brush 91B, also in a case in which the rotation speed of the fur brush 91B is increased, and also in a case in which the applied voltage is increased. Due to that, it is easy to cause a process to correspond to a high-speed process.

Second Embodiment

A second embodiment will be described using FIGS. 6 and 7 while referring to FIG. 1. It is noted that in the first embodiment, the belt cleaning unit 90 of the secondary transfer belt 12 has been described. In contrast to this, in the second embodiment, the belt cleaning unit 45 of the intermediate transfer belt 40 will be described. Since configurations and effects other than that are the same as those in the first embodiment, descriptions and illustrations thereof are omitted or simplified by giving the same reference numerals to the same configurations, and hereinafter, portions which are different from those in the first embodiment will be mainly described.

(Belt Cleaning Unit)

As illustrated in FIG. 1, the exposing unit 4Y and the developing unit 5Y form a toner image, and cause the photosensitive drum 1Y as the photosensitive member to bear the image. The primary transfer roller 6Y as an example of the first transfer member transfers the toner image which is borne in the photosensitive drum 1Y to the intermediate transfer belt 40 as an example of a moving endless belt. The secondary transfer outer roller 10 which is an example of the second transfer member transfers the toner image which is borne on the intermediate transfer belt 40 to a recording medium.

Figure 6:
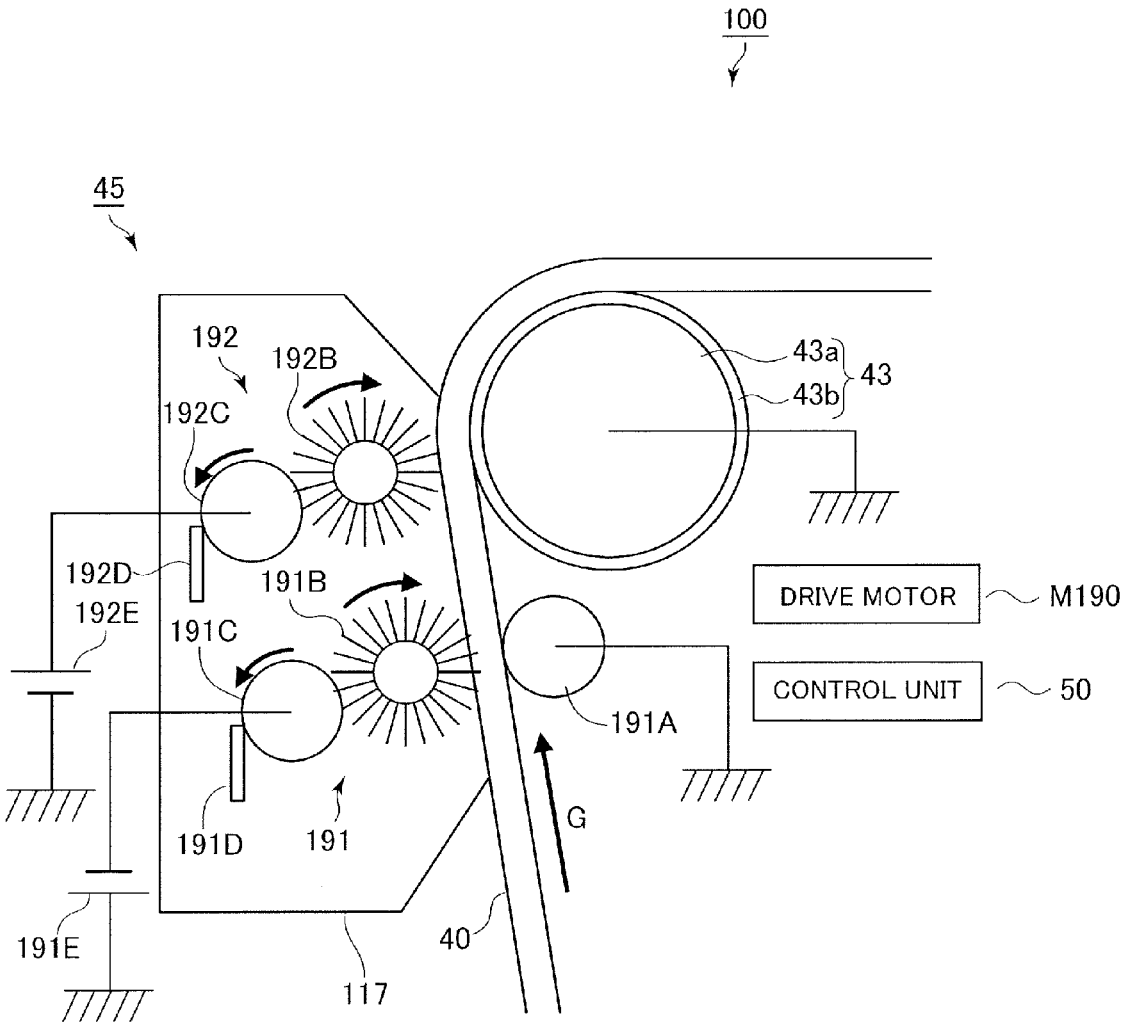
FIG. 6 is an explanatory diagram illustrating a configuration of a belt cleaning unit according to a second embodiment.

As illustrated in FIG. 6, the belt cleaning unit 45 collects toner which is charged with a negative polarity using a fur brush 192B to which a voltage with a negative polarity is applied, after collecting toner which is charged with a positive polarity using a fur brush 191B to which a voltage with a negative polarity is applied.

The fur brushes 191B and 192B, and metallic rollers 191C and 192C are connected to a drive motor M190 via a gear mechanism, and rotate in the arrow direction, respectively, by being driven by the drive motor M190. The fur brushes 191B and 192B rotate in the opposite direction from the rotation direction of the intermediate transfer belt 40 at the position facing to the intermediate transfer belt 40 and contact the intermediate transfer belt 40. The fur brushes 191B and 192B rotate in the same direction with the rotation direction of the metallic roller 191C and 192C and contact the metallic roller 191C and 192C.

The fur brushes 191B and 192B are implanted hairs of conductive nylon fiber of which volume resistivity is $10^5$ Ω·cm, and a diameter thereof is 18 mm. An inroad amount of the intermediate transfer belt 40 into the fur brushes 191B and 192B is 1.5 mm. A diameter of the metallic rollers 191C and 192C is 20 mm. An inroad amount of the metallic rollers 191C and 192C into the fur brushes 191B and 192B is 2 mm. A support roller 191A is an aluminum columnar roller, and a diameter thereof is 13 mm. In the drive roller 43, a rubber material of which a thickness is 0.5 mm, and volume resistivity is $10^5$ Ω·cm is covered on the circumferential surface of a stainless steel columnar roller, and a diameter thereof is 24 mm.

The support roller 191A is connected to a ground potential, rotates by being driven by the intermediate transfer belt 40, and supports the intermediate transfer belt 40 which is contacted with the fur brush 191B. A power supply 191E applies a voltage with a negative polarity to the metallic roller 191C. The fur brush 191B which comes into contact with the metallic roller 191C is charged with a negative polarity, and adsorbs toner which is charged with a positive polarity and adheres to the intermediate transfer belt 40. The toner which is collected by the fur brush 191B is moved to the metallic roller 191C of which a potential with a positive polarity is high, and is scratched off using a cleaning blade 191D thereafter.

Still further, toner of which a charged polarity is changed from a negative polarity to a positive polarity while rotating by adhering to the fur brush 191B returns to the intermediate transfer belt 40 from the fur brush 191B, and is collected by the fur brush 192B thereafter, in a process of passing through the fur brush 192B.

The drive roller 43 is a metallic roller 43*a* which is covered with conductive rubber 43*b*, rotates the intermediate transfer belt 40, and supports the intermediate transfer belt 40 which is contacted with the fur brush 192B. A power supply 192E applies a voltage with a positive polarity to the metallic roller 192C. The fur brush 192B which comes into contact with the metallic roller 192C is charged with a positive polarity, and adsorbs toner which is charged with a negative polarity and adheres to the intermediate transfer belt 40. The toner which is collected by the fur brush 192B is moved to the metallic roller 192C of which a potential with a negative polarity is high, and is scraped off using a cleaning blade 192D thereafter.

As described above, a cleaning unit 191 includes the fur brush 191B as an example of the first brush roller, the support roller 191A as an example of the first roller, and the power supply 191E as an example of the first power supply. The fur brush 191B contacts the outer circumferential surface of the intermediate transfer belt 40 after transferring a toner image to a recording medium. The support roller 191A comes into contact with the inner circumferential surface of the intermediate transfer belt 40 at a position corresponding to the fur brush 191B. In other words, the support roller 191A is arranged so as to nip the intermediate transfer belt between the fur brush 191B and the support roller. The power supply 191E generates an electric field between the fur brush 191B and the support roller 191A in the first direction. Still further, the metallic roller 191C as a first collecting roller collects toner from the fur brush 191B while being in contact with the fur brush 191B. The cleaning blade 191D as the first cleaning member removes toner from the metallic roller 191C while being in contact with the metallic roller 191C.

The cleaning unit 192 includes the fur brush 192B as an example of the second brush roller, the drive roller 43 as an example of the second roller, and the power supply 192E as an example of a second power supply. The fur brush 192B contacts the outer circumferential surface of the intermediate transfer belt 40 on the downstream of the fur brush 191B in the moving direction of the intermediate transfer belt 40. In other words, the fur brush 192B contacts the outer circumferential surface of the intermediate transfer belt 40 in a sliding manner after being contacted with the fur brush 191B in a sliding manner. The drive roller 43 comes into contact with the inner circumferential surface of the intermediate transfer belt 40 at a position corresponding to the fur brush 192B. In other words, the drive roller 43 is arranged so as to nip the intermediate transfer belt 40 between the fur brush 192B and the drive roller. The power supply 192E generates an electric field in the second direction which is opposite to the first direction, that is, in a direction opposite to an electric field which is generated by the power supply 191E between the fur brush 192B and the drive roller 43. Still further, the metallic roller 192C as a second collection roller collects toner from the fur brush 192B while being in contact with the fur brush 192B. The cleaning blade 192D as a second cleaning member removes toner from the metallic roller 192C while being in contact with the metallic roller 192C.

(Examination on Discharging)

Figure 7:
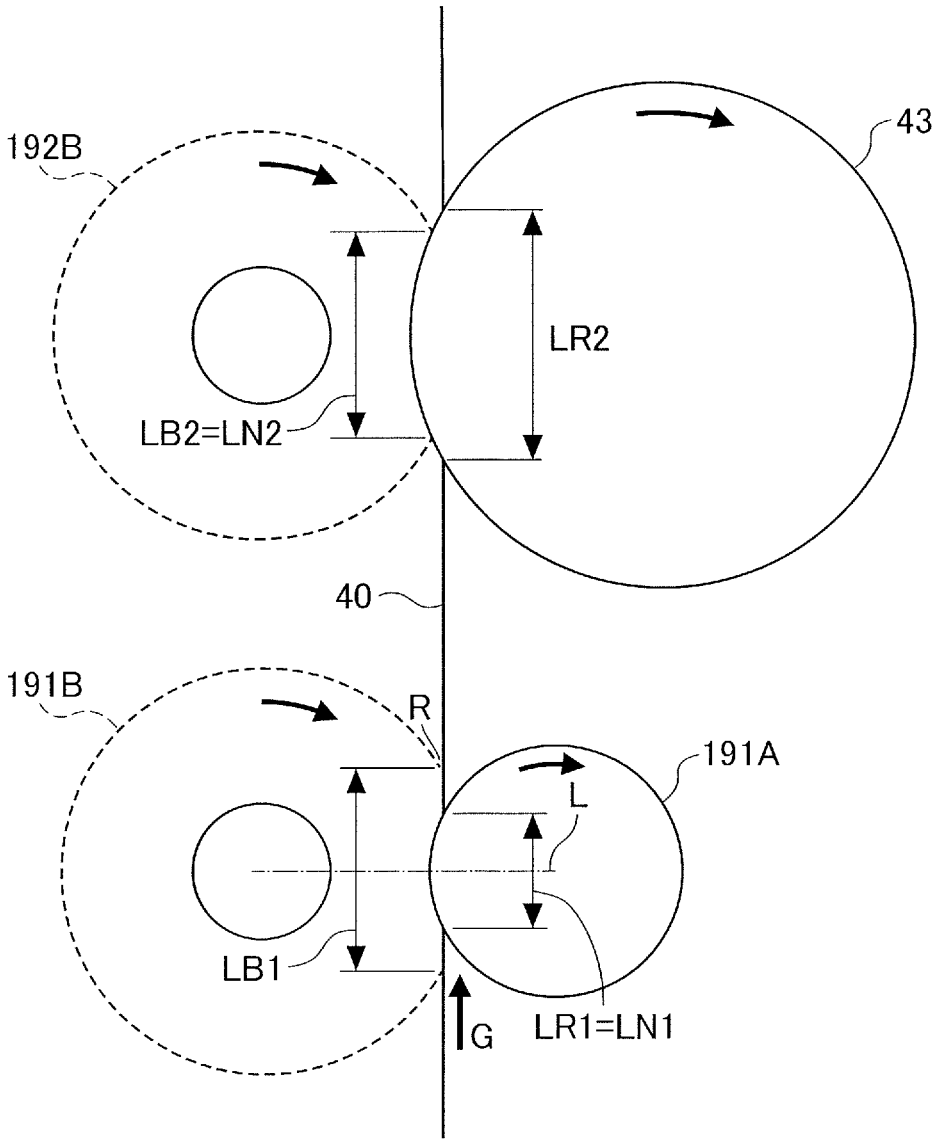
FIG. 7 is an explanatory diagram illustrating a contact length between a fur brush and a support roller according to the second embodiment.

As illustrated in FIG. 7, a length of a first contact area in which the fur brush 191B and the intermediate transfer belt 40 come into contact with each other is set to LB1. A length in a second contact area in which the support roller 191A and the intermediate transfer belt 40 come into contact with each other is set to LR1. A length of an area in which LB1 and LR1 overlap with each other in the moving direction is set to LN1.

A length of a third contact area in which the fur brush 192B comes into contact with the intermediate transfer belt 40 is set to LB2. A length of a fourth contact area in which the drive roller 43 comes into contact with the intermediate transfer belt 40 is set to LR2. A length of an area in which LB2 and LR2 overlap with each other in the moving direction is set to LN2.

At this time, the relationships of LB1>LR1 and LN1<LN2 hold, similarly to the first embodiment also in the second embodiment. At the same time, the relationships of LN1/LB1<LN2/LB2 and LN1<LN2 hold.

Due to that, also in the second embodiment, in the cleaning unit 191, discharging is remarkably suppressed, and an amount of toner which returns to the intermediate transfer belt 40 from the fur brush 191B is reduced. In the cleaning unit 192, it is possible to collect much more toner from the intermediate transfer belt 40. Role sharing in which toner collecting performance is enhanced in the fur brush 192B on the downstream side, while reducing discharging in the fur brush 191B on the upstream side become clear.

According to the second embodiment, a relationship of DR1<DR2 holds when a diameter of the support roller 191A is set to DR1, and a diameter of the drive roller 43 is set to DR2. Due to that, it is possible to easily establish a relationship in the above described each expression.

According to the second embodiment, the drive roller 43 is a roller wrapped around and stretching the intermediate transfer belt 40 after transferring a toner image to a recording medium. Due to that, it is not required to provide an exclusive counter roller which faces the fur brush 192B.

According to the second embodiment, the drive roller is configured by covering the circumferential surface of the metallic roller 43*a* with conductive rubber 43*b*. Due to that, discharging is hardly generated between the fur brush 192B and the intermediate transfer belt 40.

According to the second embodiment, the voltage V1 with the same polarity with a charged polarity of toner is applied to the fur brush 191B, and the voltage V2 with a polarity reverse to a charged polarity of toner is applied to the fur brush 192B. At this time, the relationship of |V1|>|V2| holds. Due to that, in the fur brush 191B on the upstream side, it is possible to efficiently collect toner which is charged with a positive polarity, and is a major component in transfer residual toner while satisfying the relationship of LN1<LN2. Due to that, the intermediate transfer belt 40 can easily cope with high speed.

OTHER EMBODIMENTS

The above described first and second embodiments are merely examples of the embodiments of this disclosure, and this disclosure is not limited to specific configurations of the above described first and second embodiments.

In the first embodiment, a belt cleaning unit of a belt which conveys a recording medium while bearing the medium has been described; however, there is no limitation to this, and it is also possible to execute this disclosure in a belt cleaning unit of a photosensitive member belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-196385, filed Sep. 26, 2014, which is hereby incorporated by reference herein in its entirety.

What is claimed is:

1. An image forming apparatus, comprising:

a moving endless belt, the endless belt moving while bearing a recording medium or a toner image on an outer circumferential surface thereof;

a first brush roller configured to contact the outer circumferential surface of the endless belt;

a first roller being in contact with an inner circumferential surface of the endless belt at a position corresponding to the first brush roller;

a first power supply generating an electric field in a first direction between the first brush roller and the first roller;

a second brush roller contacting the outer circumferential surface of the endless belt downstream of the first brush roller in a moving direction of the endless belt;

a second roller being in contact with the inner circumferential surface of the endless belt at a position corresponding to the second brush roller; and a second power supply generating an electric field in a second direction which is a direction opposite to the first direction between the second brush roller and the second roller, wherein relationships of LB1>LR1 and LN1<LN2 are satisfied, where LB1 is a length of a first contact area in the moving direction in which the first brush roller and the endless belt come into contact with each other, LR1 is a length of a second contact area in the moving direction in which the first roller and the endless belt come into contact with each other, a third contact area is an area in which the second brush roller and the endless belt come into contact with each other, a fourth contact area is an area in which the second roller and the endless belt come into contact with each other, LN1 is a length of an area in which the first contact area overlaps with the second contact area in the moving direction, and LN2 is a length of an area in which the third contact area overlaps with the fourth contact area in the moving direction.

2. The image forming apparatus according to claim 1, wherein the endless belt moves while bearing the recording medium on an outer circumferential surface thereof, wherein the image forming apparatus further comprises:

an image bearing member; and a transfer member transferring the toner image which is borne on the image bearing member to the recording medium which is borne on the endless belt, and wherein the first brush roller is disposed downstream of the transfer member in the moving direction, and the second brush roller is disposed downstream of the first brush roller and upstream of the transfer member in the moving direction.

3. The image forming apparatus according to claim 1, wherein the endless belt moves while bearing the toner image on the outer circumferential surface thereof, wherein the image forming apparatus further comprises:

a photosensitive member;

a first transfer member transferring the toner image which is borne on the photosensitive member to the endless belt; and a second transfer member transferring the toner image which is borne on the endless belt to the recording medium, wherein the first brush roller is disposed downstream of the second transfer member in the moving direction, and the second brush roller is disposed downstream of the first brush roller and upstream of the first transfer member in the moving direction.

4. The image forming apparatus according to claim 1, wherein a relationship of LN1/LB1<LN2/LB2 is satisfied, where LB2 is a length of the third contact area in the moving direction.

5. The image forming apparatus according to claim 1, wherein a condition DR1<DR2 is satisfied, where DR1 is a diameter of the first roller and DR2 is a diameter of the second roller.

6. The image forming apparatus according to claim 1, wherein the second roller is wrapped by and stretches the endless belt.

7. The image forming apparatus according to claim 1, wherein the second roller is composed of a metallic roller whose circumferential surface is coated by a conductive rubber material.

8. The image forming apparatus according to claim 1, further comprising:

a first collecting roller collecting toner from the first brush roller by being in contact with the first brush roller;

a first cleaning member removing the toner from the first collecting roller by being in contact with the first collecting roller;

a second collecting roller collecting toner from the second brush roller by being in contact with the second brush roller; and a second cleaning member removing the toner from the second collecting roller by being in contact with the second collecting roller.

9. The image forming apparatus according to claim 2, wherein a voltage of a polarity reverse to a charged polarity of toner is applied to the first brush roller and a voltage of the same polarity as the charged polarity of toner is applied to the second brush roller, and wherein a relationship of $|V1|>|V2|$ is satisfied, where V1 is the voltage applied to the first brush roller and V2 is the voltage applied to the second brush roller.

10. The image forming apparatus according to claim 3, wherein a voltage of the same polarity as a charged polarity of toner is applied to the first brush roller and a voltage of a polarity reverse to a charged polarity of toner is applied to the second brush roller, and wherein a relationship of $|V1|>|V2|$ is satisfied, where V1 is the voltage applied to the first brush roller, and V2 is the voltage applied to the second brush roller.

11. An image forming apparatus, comprising:

a moving endless belt, the endless belt moving while bearing a recording medium or a toner image on an outer circumferential surface thereof;

a first brush roller contacting an outer circumferential surface of the endless belt;

a first roller being in contact with an inner circumferential surface of the endless belt at a position corresponding to the first brush roller;

a first power supply generating an electric field in a first direction between the first brush roller and the first roller;

a second brush roller contacting the outer circumferential surface of the endless belt downstream of the first brush roller in a moving direction of the endless belt;

a second roller being in contact with the inner circumferential surface of the endless belt at a position corresponding to the second brush roller; and a second power supply generating an electric field in a second direction which is a direction opposite to the first direction between the second brush roller and the second roller, wherein relationships of $LN1/LB1<LN2/LB2$ and $LN1<LN2$ are satisfied, where LB1 is a length of a first contact area in the moving direction in which the first brush roller and the endless belt come into contact with each other, a second contact area is an area in which the first roller and the endless belt come into contact with each other, LB2 is a length of a third contact area in the moving direction in which the second brush roller and the endless belt come into contact with each other, a fourth contact area is an area in which the second roller and the endless belt come into contact with each other, LN1 is a length of an area in which the first contact area overlaps with the second contact area in the moving direction, and LN2 is a length of an area in which the third contact area overlaps with the fourth contact area in the moving direction.

12. The image forming apparatus according to claim 11, wherein the endless belt moves while bearing the recording medium on an outer circumferential surface thereof, wherein the image forming apparatus further comprises:

an image bearing member; and a transfer member transferring the toner image which is borne on the image bearing member to the recording medium which is borne on the endless belt, and wherein the first brush roller is disposed downstream of the transfer member in the moving direction, and the second brush roller is disposed downstream of the first brush roller and upstream of the transfer member in the moving direction.

13. The image forming apparatus according to claim 11, wherein the endless belt moves while bearing the toner image on the outer circumferential surface thereof, wherein the image forming apparatus further comprises:

a photosensitive member;

a first transfer member transferring the toner image which is borne on the photosensitive member to the endless belt; and a second transfer member transferring the toner image which is borne on the endless belt to the recording medium, wherein the first brush roller is disposed downstream of the second transfer member in the moving direction, and the second brush roller is disposed downstream of the first brush roller and upstream of the first transfer member in the moving direction.

14. The image forming apparatus according to claim 11, wherein a relationship of $DR1<DR2$ is satisfied, where DR1 is a diameter of the first roller, and DR2 is a diameter of the second roller.

15. The image forming apparatus according to claim 11, wherein the second roller is wrapped by and stretches the endless belt.

16. The image forming apparatus according to claim 11, wherein the second roller is composed of a metallic roller whose circumferential surface is coated by a conductive rubber material.

17. The image forming apparatus according to claim 11, further comprising:

a first collecting roller collecting toner from the first brush roller by being in contact with the first brush roller;

a first cleaning member removing the toner from the first collecting roller by being in contact with the first collecting roller;

a second collecting roller collecting the toner from the second brush roller by being in contact with the second brush roller; and a second cleaning member removing the toner from the second collecting roller by being in contact with the second collecting roller.

18. The image forming apparatus according to claim 12, wherein a voltage of a polarity reverse to a charged polarity of toner is applied to the first brush roller, and a voltage of the same polarity as the charged polarity of toner is applied to the second brush roller, and wherein a relationship of $|V1|>|V2|$ is satisfied, where V1 is the voltage applied to the first brush roller, and V2 is the voltage applied to the second brush roller.

19. The image forming apparatus according to claim 13, wherein a voltage of the same polarity as a charged polarity of toner is applied to the first brush roller, and a voltage of a polarity reverse to the charged polarity of toner is applied to the second brush roller, and wherein a relationship of $|V1|>|V2|$ is satisfied, where V1 is the voltage applied to the first brush roller, and V2 is the voltage applied to the second brush roller.

* * * * *